US006164500A

United States Patent [19]

Abe et al.

[11] Patent Number: 6,164,500

[45] Date of Patent: Dec. 26, 2000

[54] METHOD OF REMOVING AIR FROM LIQUID CHANNEL OF LIQUID FILLING APPARATUS

[75] Inventors: Kazuo Abe; Makoto Fukui; Hiroshi Kitajima; Michio Ueda, all of Tokushima, Japan

[73] Assignee: Shikoku Kakoki Co., Ltd., Tokushima, Japan

[21] Appl. No.: 09/427,040

[22] Filed: Oct. 26, 1999

[30] Foreign Application Priority Data

Oct. 29, 1998 [JP] Japan ..... 10-307923

[51] Int. Cl.[7] ..... B67D 5/40

[52] U.S. Cl. ..... 222/380; 222/504

[58] Field of Search ..... 222/380, 372, 222/504, 495, 497

[56] References Cited

U.S. PATENT DOCUMENTS 5,765,729 6/1998 Miller et al. ..... 222/380
5,769,136 6/1998 Kanematsu et al. ..... 222/504

FOREIGN PATENT DOCUMENTS 0 775 635 A1 5/1997 European Pat. Off. .
1039190 8/1966 United Kingdom .

*Primary Examiner*—Philippe Derakshani
*Attorney, Agent, or Firm*—Armstrong, Westerman, Hattori, McLeland & Naughton

[57] ABSTRACT

For use in a liquid filling apparatus having a liquid channel extending from a liquid tank to a filling nozzle via a metering cylinder, an upper check valve disposed upstream from the metering cylinder and a lower check valve disposed downstream from the cylinder, a method of removing air from the interior of the liquid channel comprises the liquid feeding step of closing the lower check valve, opening the upper check valve and feeding the liquid to be filled from the liquid tank to the liquid channel to an upstream side of the lower check valve; the primary air removing step of closing the upper check valve, opening the lower check valve, and causing the liquid to flow from the upstream side of the lower check valve downstream from the lower check valve while allowing air at a downstream side of the lower check valve to flow in between the valves to replace the liquid at the upstream side of the lower check valve with the air at the downstream side of the lower check valve; and the secondary air removing step of closing the lower check valve, opening the upper check valve, causing the air to flow from between the valves to an upstream side of the upper check valve and discharging the air from the interior of the liquid channel through the liquid tank.

2 Claims, 2 Drawing Sheets

METHOD OF REMOVING AIR FROM LIQUID CHANNEL OF LIQUID FILLING APPARATUS

BACKGROUND OF THE INVENTION

The present invention relates to a method of removing air from a liquid channel, for example, of a liquid filling apparatus before the start of a filling operation, the apparatus being adapted to fill a liquid into containers in a specified amount in each container.

Such a method is already known for use in liquid filling apparatus which comprise an apparatus body having a liquid channel connected at one end thereof to a liquid tank and having at the other end thereof an opening serving as an outlet of a filling nozzle, a metering cylinder provided in the liquid channel between opposite ends thereof in communication with the ends, an upper check valve disposed in the liquid channel upstream from the metering cylinder of the liquid channel, a lower check valve provided in the liquid channel downstream from the metering cylinder, and a downflow preventing member provided at the outlet for preventing the liquid to be filled from flowing down under gravity by the surface tension of the liquid. The method comprises the liquid feeding step of closing the lower check valve, opening the upper check valve and feeding the liquid in the tank to the liquid channel to the upstream side of the lower check valve, and the air removing step of opening the lower check valve with the upper check valve held open, causing the liquid to flow from the upstream side of the lower check valve to the downstream side of the lower check valve and discharging air from the downstream side of the lower check valve through the outlet along with the liquid.

This method is adapted to remove air by allowing the liquid to flow out and is unable to discharge air alone from the downstream side of the lower check valve through the outlet, thus inevitably discharging the liquid along with the air. The quantity of the liquid discharged with the air is as much as several liters. This portion of liquid can be handled in no way other than disposal, is uneconomical and results in a very low yield of the liquid to be filled.

SUMMARY OF THE INVENTION

An object of the present invention is to provide a method of removing air from the liquid channel of a liquid filling apparatus without wasting the liquid to be filled.

For use in a liquid filling apparatus which comprises an apparatus body having a liquid channel connected at one end thereof to a liquid tank and having at the other end thereof an opening serving as an outlet of a filling nozzle, a metering cylinder provided in the liquid channel between opposite ends thereof in communication with the ends, an upper check valve disposed in the liquid channel upstream from the metering cylinder of the liquid channel, a lower check valve provided in the liquid channel downstream from the metering cylinder, and a downflow preventing member provided at the outlet for preventing a liquid to be filled from flowing down under gravity, the present invention provides a method of removing air from the interior of the liquid channel which method comprises the liquid feeding step of closing the lower check valve, opening the upper check valve and feeding the liquid to be filled from the liquid tank to the liquid channel to an upstream side of the lower check valve; the primary air removing step of closing the upper check valve, opening the lower check valve, and causing the liquid to flow from the upstream side of the lower check valve downstream from the lower check valve while allowing air at a downstream side of the lower check valve to flow in between the lower check valve and the upper check valve to replace the liquid at the upstream side of the lower check valve with the air at the downstream side of the lower check valve; and the secondary air removing step of closing the lower check valve, opening the upper check valve, causing the air to flow from between the lower and upper check valves to an upstream side of the upper check valve and discharging the air from the interior of the liquid channel through the liquid tank.

According to the method of the invention, air at the downstream side of the lower check valve is allowed to flow in between the lower and upper check valves by the primary air removing step, and the air is discharged from the liquid channel through the liquid tank by the secondary air removing step, during which the lower check valve is held closed. Accordingly, there is no likelihood of the liquid leaking from the outlet. The air can therefore be removed from the interior of the filling apparatus without wasting the liquid.

In the filling apparatus, it is desired that the ratio of the volume of the liquid channel between the lower check valve and the upper check valve to the volume of the liquid channel downstream from the lower check valve be 1.5–3:1.

If the ratio is in excess of 3, the liquid between the upper and lower check valves will forcibly pass through the lower check valve under gravity to flow downstream therefrom, with the resulting likelihood that the liquid flowing down will be urged to leak from the outlet. When the ratio is less than 1.5, it is likely that the liquid will not be replaced with a sufficient quantity of air.

DESCRIPTION OF THE PREFERRED EMBODIMENT

Figure 1:
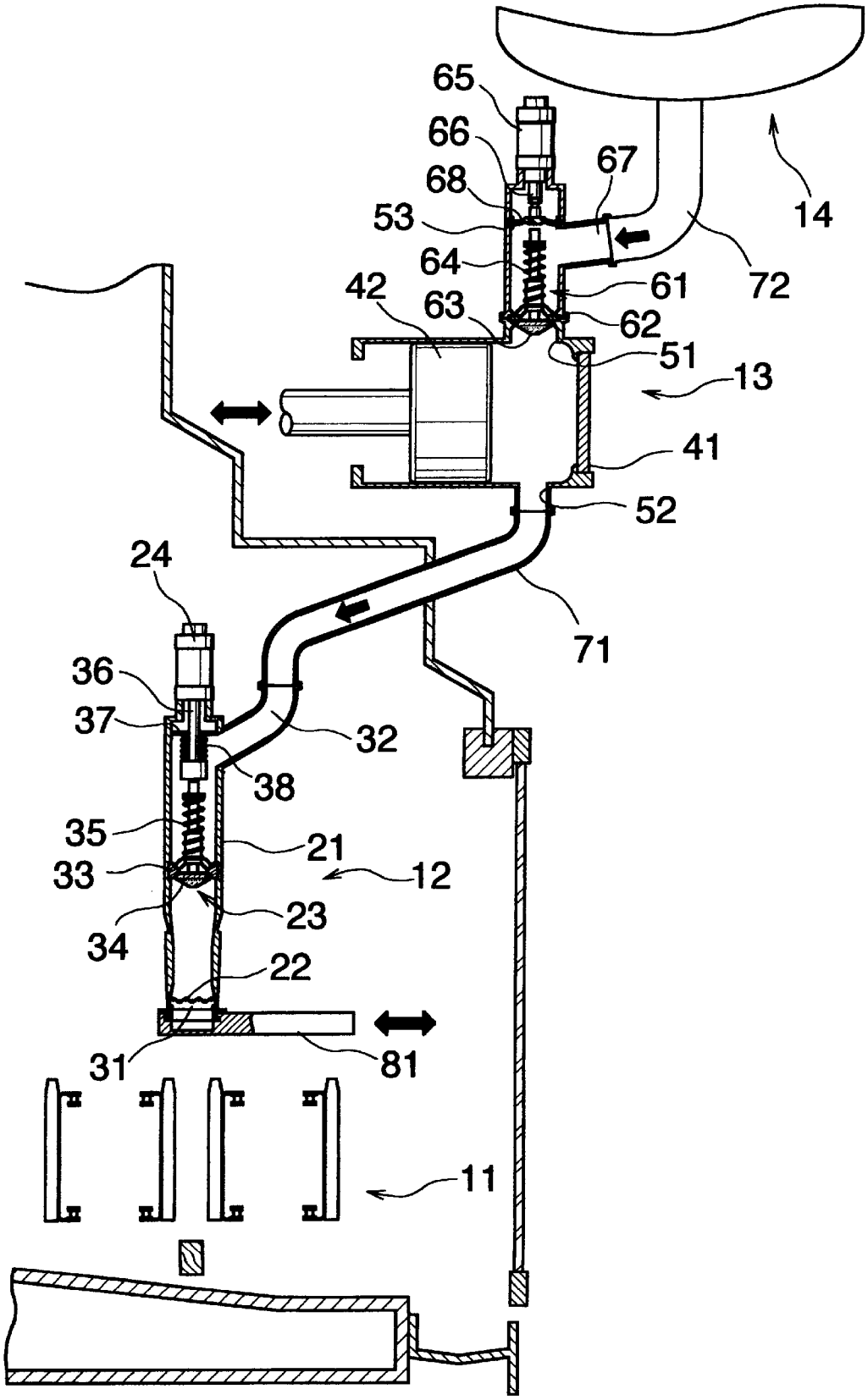
FIG. 1 is a diagram showing the construction of a filling apparatus for use in the invention.

An embodiment of the present invention will be described below with reference to the drawings.

The filling apparatus shown comprises a filling nozzle 12 disposed above the path of transport of a container conveyor 11, a metering cylinder 13 for feeding the liquid to be filled to the nozzle 12 in a specified amount at a time, and a tank 14 for containing the liquid to be fed to the metering cylinder 13.

The filling nozzle 12 comprises a vertical tubular nozzle body 21, a net 22 provided at the lower end of the nozzle body 21 for causing the surface tension of the liquid within the nozzle body 21 to prevent the liquid from flowing down under gravity, a lower check valve 23 disposed within the nozzle body 21 at the approximate midportion of its height for permitting the passage of the liquid therethrough downward, and a fluid pressure cylinder 24 attached as directed downward to the upper end of the nozzle body 21 for opening the lower check valve 23 by pushing down.

The nozzle body 21 has a downward outlet 31 at its lower end and a lateral inlet 32 positioned above the check valve 23 and close to the upper end of the body. The lower check valve 23 comprises a valve disk 34 positioned under and in intimate contact with a seat ring 33, and a spring 35 for biasing the valve disk 34 upward. The fluid pressure cylinder 24 has a rod 36 extending into the nozzle body 21 and in bearing contact with valve disk 34. A partition plate 37 is provided inside the nozzle body 21 transversely thereof at the level of upper end of the inlet 32. The rod 36 extends through the partition plate 37. A seal member 38 in the form of bellows is provided between the rod 36 and the inner periphery of the plate 37 defining a rod insertion hole. This arrangement prevents air from remaining inside the nozzle body 21 above the position of the inlet 32.

The metering cylinder 13 comprises a horizontal cylinder body 41 having a closed end, and a piston 42 housed in the cylinder body 41.

The cylinder body 41 has close to its closed end an inlet 51 facing upward and an outlet 52 facing downward. The edge portion of the inlet 51 is provided with a vertical connecting tubular portion 53 communicating with the inlet. An upper check valve 61 is provided inside the connecting tubular portion 53 for permitting the liquid to pass through the inlet 51 downward. The upper check valve 61, which has the same construction as the lower check valve 23, comprises a seat ring 62, a valve disk 63, and a spring 64. A fluid pressure cylinder 65 directed downward is mounted on the upper end of the connecting tubular portion 53. The cylinder 65 has a piston rod 66 in bearing contact with the valve disk 63 of the upper check valve 61. The tubular portion 53 is formed at a portion thereof upstream from the valve 61 with a lateral communication opening 67. A diaphragm 68 is provided inside the tubular portion 53 transversely thereof at the level of upper end of the communication opening, thereby preventing air from remaining in the interior part of the tubular portion 53 above the opening 67. The rod 66 is connected to the center of upper side of the diaphragm 68.

The inlet 32 of the filling nozzle 12 is held in communication with the outlet 52 of the metering cylinder 13 by a lower connecting pipe 71. The liquid tank 14 is held in communication with the opening 67 of the connecting tubular portion 53 by an upper connecting pipe 72. This arrangement provides a continuous liquid channel extending from the liquid tank 14 to the outlet 31 of the filling nozzle 12 through the metering cylinder 13.

The filling apparatus is further provided with a cleaning device (not shown in its entirety) for cleaning the interior of the apparatus when a filling operation is to be started or for a change of the liquid to be filled. The device has an adaptor 81 removably attachable to the outlet 31 of the filling nozzle 12. The liquid tank 14 can be supplied with the liquid to be filled or a cleaning liquid selectively. The cleaning liquid supplied to the filling apparatus for cleaning is collected through the adaptor 81 after passing through the apparatus.

For the filling operation in a steady state, the lower and upper check valves 23, 61 are both closed. When the piston 42 of the metering cylinder 13 is moved leftward in FIG. 1, a negative pressure is produced within the cylinder 13, forcing the upper check valve 61 open and allowing the liquid to be filled to flow out of the tank 14 into the metering cylinder 13 through the inlet 51. When the piston 42 is subsequently moved rightward, a positive pressure is produced in the cylinder 13 since the upper check valve 61 prevents the upward flow of the liquid, whereby the liquid within the metering cylinder 13 is sent into the filling nozzle 12 through the outlet 52. The liquid sent in forces the lower check valve 23 open to flow down the nozzle body 21 and is discharged from the outlet 31 through the net 22.

Next with reference to FIG. 2, a description will be given of the operation to be performed before the start of the filling operation for removing air from the interior of the filling apparatus.

Figure 2:
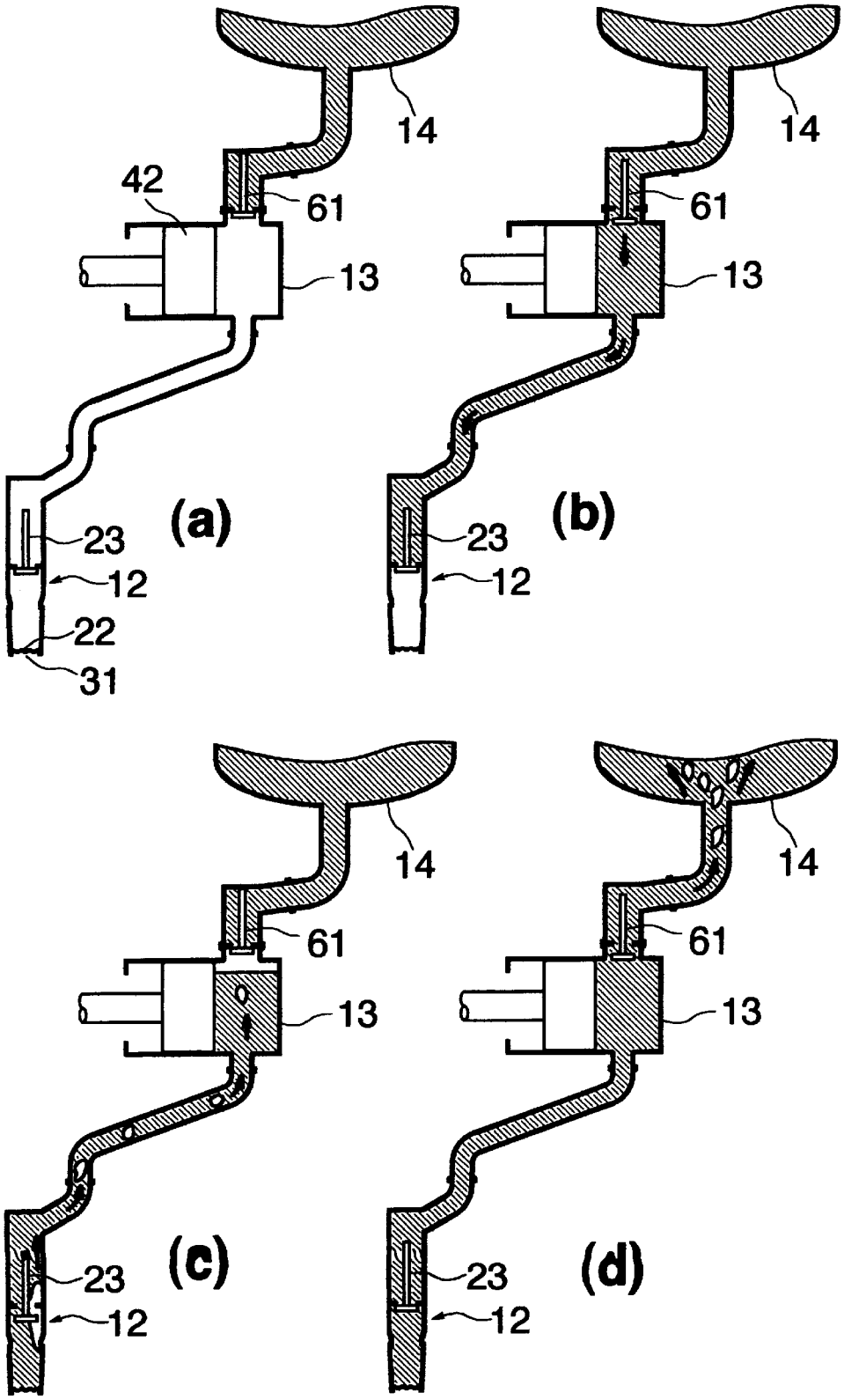
FIG. 2 includes diagram for illustrating the air removing operation of the method.

First, the lower and upper check valves 23, 61 are both closed [FIG. 2(*a*)]. When the upper check valve 61 is opened in this state, the liquid to be filled flows into the metering cylinder 13 through the valve 61, further passes through the metering cylinder 13 and flows also into the filling nozzle 12 [FIG. 2(*b*)], whereby the interior portion of the liquid channel upstream from the lower check valve 23 is filled with the liquid. Air remains in the interior portion of the filling nozzle 12 downstream from the lower check valve 23. Subsequently when the upper check valve 61 is closed and the lower check valve 23 is opened, the air remaining downstream from the valve 23 flows upstream from the valve 23, permitting the liquid present upstream from the lower check valve 23 to flow downstream therefrom for replacement [FIG. 2(*c*)]. The air flowing upstream from the valve 23 is retained in the vicinity of the upper check valve 61. The liquid flowing downstream from the lower check valve 23 is prevented from flowing down by the net 22 and is therefore unlikely to flow out from the outlet 31. When the liquid is replaced by the whole amount of air, the lower check valve 23 is closed, and the upper check valve 61 is opened [FIG. 2(*d*)], whereupon the air retained in the vicinity of the upper check valve 61 passes through the valve 61 and flows upstream therefrom. The flow of air is discharged to a specified portion through the liquid tank 14, whereby the air removing operation is completed.

After the step shown in FIG. 2(*d*), the metering cylinder 13 is operated with the upper check valve 61 held open, whereby small bubbles adhering to the inner surface of the metering cylinder 13 and the inner wall surface defining the liquid channel can also be removed.

For the replacement of the liquid with air in the operation described above, the volume of the liquid channel between the lower check valve 23 and the upper check valve 61 needs to be greater than the volume of the interior portion of the filling nozzle 12 downstream from the lower check valve 23, whereas if the former is excessively greater than the latter, the liquid between the valves 23 and 61 will forcibly pass through the lower valve 61 under gravity to flow downstream therefrom, with the resulting likelihood that the downflow of the liquid will be urged to leak from the outlet 31. The volume ratio is preferably 1.5–3:1. When the ratio is in this range, the above drawback will not result to ensure smooth removal of air. The quantity of dripping liquid can be up to several cubic centimeters if greatest.

It is desirable to attach the adaptor 81 to the outlet 31 of the filling nozzle 12 for the air removal operation described. Even if a small amount of liquid drips from the outlet 31, this liquid portion is collected by the adaptor 81 to eliminate the likelihood that the dripping liquid will soil the surroundings of the nozzle 12 to assure a clean environment.

The air removal operation can be performed automatically by controlling the two fluid pressure cylinders in sequence without resorting to manual work.

The nozzle outlet 31 is provided with the net 22 as a member for preventing downflow of the liquid for use as a reticular nozzle adapted to prevent the liquid from flowing down under gravity by the surface tension of the liquid. However, alternatively usable is a rubber nozzle, i.e., a nozzle of the type having an outlet which is opened and closed utilizing the elastic force of rubber, such that the outlet is opened against the elastic force when the liquid is forced into the nozzle from the metering cylinder, or is closed by the elastic force when the liquid supply is discontinued.

Although the metering cylinder shown is of the horizontal type, a cylinder of the vertical type may alternatively be used.

What is claimed is:

1. In a liquid filling apparatus which comprises an apparatus body having a liquid channel connected at one end thereof to a liquid tank and having at the other end thereof an opening serving as an outlet of a filling nozzle, a metering cylinder provided in the liquid channel between opposite ends thereof in communication with the ends, an upper check valve disposed in the liquid channel upstream from the metering cylinder of the liquid channel, a lower check valve provided in the liquid channel downstream from the metering cylinder, and a downflow preventing member provided at the outlet for preventing a liquid to be filled from flowing down under gravity, a method of removing air from the interior of the liquid channel comprising:

the liquid feeding step of closing the lower check valve, opening the upper check valve and feeding the liquid to be filled from the liquid tank to the liquid channel to an upstream side of the lower check valve, the primary air removing step of closing the upper check valve, opening the lower check valve, and causing the liquid to flow from the upstream side of the lower check valve downstream from the lower check valve while allowing air at a downstream side of the lower check valve to flow in between the lower check valve and the upper check valve to replace the liquid at the upstream side of the lower check valve with the air at the downstream side of the lower check valve, and the secondary air removing step of closing the lower check valve, opening the upper check valve, causing the air to flow from between the lower and upper check valves to an upstream side of the upper check valve and discharging the air from the interior of the liquid channel through the liquid tank.

2. A method of removing air from the interior of the liquid channel according to claim 1 wherein the ratio of the volume of the liquid channel between the lower check valve and the upper check valve to the volume of the liquid channel downstream from the lower check valve is 1.5–3:1.

* * * * *